US010930119B2

(12) United States Patent
Moskowitz

(10) Patent No.: US 10,930,119 B2
(45) Date of Patent: Feb. 23, 2021

(54) SYSTEMS AND A METHODS FOR PLAYING MULTI-ZONE TWENTY ONE (21) ACROSS ELECTRONIC GAMING SYSTEMS AND SCRATCH OFF TICKETS

(71) Applicant: Ahmnon D. Moskowitz, Rockville, MD (US)

(72) Inventor: Ahmnon D. Moskowitz, Rockville, MD (US)

( * ) Notice: Subject to any disclaimer, the term of this patent is extended or adjusted under 35 U.S.C. 154(b) by 380 days.

(21) Appl. No.: 15/722,089

(22) Filed: Oct. 2, 2017

(65) Prior Publication Data

US 2018/0082540 A1 Mar. 22, 2018

Related U.S. Application Data

(63) Continuation-in-part of application No. 15/162,541, filed on May 23, 2016, now Pat. No. 9,965,624, which is a continuation-in-part of application No. 14/332,351, filed on Jul. 15, 2014, now Pat. No. 9,898,895.

(Continued)

(51) Int. Cl.
*A63F 9/24* (2006.01)
*G07F 17/32* (2006.01)

(52) U.S. Cl.
CPC ..... *G07F 17/3293* (2013.01); *G07F 17/322* (2013.01); *G07F 17/329* (2013.01); *G07F 17/3209* (2013.01); *G07F 17/3223* (2013.01); *G07F 17/3244* (2013.01);

(Continued)

(58) Field of Classification Search
CPC ..... G07F 17/329
See application file for complete search history.

(56) References Cited

U.S. PATENT DOCUMENTS 3,796,433 A 3/1974 Fraley et al.
4,339,134 A 7/1982 MacHeel (Continued)

FOREIGN PATENT DOCUMENTS

WO 2004015529 A2 2/2004

OTHER PUBLICATIONS

"7 11 21 Lottery Scratch off tickets." Youtube.com. Online. May 28, 2012. Accessed via the Internet. Accessed Apr. 22, 2020. <URL: https://www.youtube.com/watch?v=AF7bSarQkBQ> (Year: 2012).*

(Continued)

*Primary Examiner* — Dmitry Suhol
*Assistant Examiner* — Carl V Larsen
(74) *Attorney, Agent, or Firm* — The Roy Gross Law Firm, LLC; Roy Gross

(57) ABSTRACT

Systems and methods for wagering games that award prizes for reaching numerical objectives. A system for a multi-zone twenty-one (21) themed game whereby if the player achieves twenty-one (21) in a plurality of zones a payout is awarded. A top payout is awarded for twenty-one (21) in all of the zones and a subordinate payout is awarded for twenty-one (21) in greater than fifty percent of the plurality of zones. Scratch-off lottery games with adding themes, such that a payout is awarded if a line contains the numerical objective twenty-one (21) a payout is awarded and if a player reaches a numerical objective in the maximum amount of lines a top payout is awarded. A table game of twenty-one (21) in a plurality of zones for reaching numerical objectives.

17 Claims, 10 Drawing Sheets

Related U.S. Application Data

(60) Provisional application No. 62/403,195, filed on Oct. 2, 2016, provisional application No. 62/165,870, filed on May 22, 2015, provisional application No. 61/846,608, filed on Jul. 15, 2013.

(52) U.S. Cl.
CPC ..... *G07F 17/3248* (2013.01); *G07F 17/3262* (2013.01); *G07F 17/3276* (2013.01); *G07F 17/3288* (2013.01)

(56) References Cited

U.S. PATENT DOCUMENTS 4,380,334 A 4/1983 Minkoff et al.
5,154,429 A 10/1992 LeVasseur
5,257,789 A 11/1993 Levasseur
5,395,119 A 3/1995 Jacob et al.
5,605,334 A 2/1997 McCrea, Jr.
5,791,991 A 8/1998 Small
5,823,873 A 10/1998 Moody
6,345,823 B1 2/2002 Webb
6,581,937 B1 6/2003 Crisswell
6,588,747 B1 * 7/2003 Seelig ..... G07F 17/32 273/138.1
7,367,564 B2 5/2008 Latell
7,591,728 B2 9/2009 Gioia et al.
7,758,411 B2 7/2010 Crawford, III et al.
7,785,182 B2 8/2010 Thomas et al.
7,785,184 B2 8/2010 Jubinville et al.
7,824,254 B2 11/2010 Dunaevsky et al.
8,926,421 B2 1/2015 Arezina et al.
9,257,006 B2 2/2016 Gagner et al.
9,286,747 B2 3/2016 Chang
9,552,701 B2 1/2017 Pececnik
9,679,303 B1 * 6/2017 Griffin ..... G06Q 30/0214
2002/0111205 A1 8/2002 Beavers
2002/0147042 A1 10/2002 Vuong et al.
2003/0027621 A1 2/2003 Libby
2003/0181235 A1 * 9/2003 Bennett, III ..... G07F 17/42 463/17
2004/0015529 A1 6/2004 Tanrikulu et al.
2004/0176155 A1 9/2004 Gold et al.
2007/0120320 A1 5/2007 Miltenberger et al.
2007/0135203 A1 6/2007 Nicely
2008/0073852 A1 * 3/2008 Cutchin ..... A63F 3/0665 273/431
2008/0076572 A1 3/2008 Nguyen et al.
2008/0246219 A1 10/2008 Kyrychenko
2009/0121425 A1 * 5/2009 Berkowitz ..... A63F 3/0665 273/139
2009/0121434 A1 5/2009 Baerlocher et al.
2009/0295087 A1 12/2009 Kling et al.
2010/0078892 A1 4/2010 Gore
2010/0121719 A1 * 5/2010 Blair ..... G07F 17/329 705/14.64
2010/0130280 A1 5/2010 Arezina et al.
2010/0213671 A1 8/2010 Ko
2010/0261515 A1 10/2010 Tobias et al.
2010/0298039 A1 11/2010 Dunaevsky et al.
2011/0042896 A1 * 2/2011 Napolitano ..... G07F 17/3267 273/269
2011/0057390 A1 3/2011 Scalisi
2011/0140359 A1 6/2011 Polynice
2011/0244951 A1 * 10/2011 Shaw ..... G07F 17/32 463/26
2013/0102381 A1 4/2013 Nelson et al.
2014/0038680 A1 2/2014 Pececnik et al.
2014/0094238 A1 4/2014 Huxley et al.
2015/0266662 A1 * 9/2015 Bajrami ..... B65D 59/04 426/5
2015/0325079 A1 * 11/2015 Alsip ..... G07F 17/323 463/20
2016/0379443 A1 12/2016 Abbott
2017/0046910 A1 2/2017 Sherrets et al.
2017/0053473 A1 * 2/2017 Colvin ..... G07F 17/3246
2017/0345257 A1 11/2017 Gagner

OTHER PUBLICATIONS

Golden Bingo—GM #77. molottery.com. Online. Sep. 28, 2015. Accessed via the Internet. Accessed Apr. 22, 2020. <URL: http://www.molottery.com/scratchers.do?method=singlegame&game=77> (Year: 2015).*
Run the Table. ctlottery.com. Online. Apr. 25, 2016. Accessed Apr. 22, 2020. <URL: https://www.ctlottery.org/ScratchGames/1337/> (Year: 2016).*
"$5 High Roller Poker Scratcher—CA Lottery—Beat a Straight" Youtube.com. Online. Apr. 20, 2014. Accessed via the Internet. Accessed Oct. 22, 2020. <URL: https://www.youtube.com/watch?v=t-xQV0IxQkY> (Year: 2014).*
https://en.wikipedia.org/wiki/Catch_21. Accessed Jul. 16, 2018.
https://play.google.com/store/apps/details?id=air.com.differencegames.towerof21free, Accessed Jul. 16, 2018.
https://www.gsn.com/games/free/catch21, Accessed Jul. 16, 2018.
https://en.wikipedia.org/wiki/Catch_21.
https://play.google.com/store/apps/details?id=air.com.differencegames.towerof21free.
http://www.gsn.com/games/free/catch21/.
Allen Chan, National Search Report U.S. Appl. No. 14/332,351 dated May 12, 2016.

* cited by examiner

Add up your numbers in each of the two outer circles. If your numbers add up to the game numbers win the prize Add up the numbers in the arrows. If the numbers ad up to a number in the game center win the prize below

| | |
|---|---|
| 11 | 2 to 1 |
| 10,12,13,14,15,16 | 10 to 1 |
| 17& up | 12 to one |

SYSTEMS AND A METHODS FOR PLAYING MULTI-ZONE TWENTY ONE (21) ACROSS ELECTRONIC GAMING SYSTEMS AND SCRATCH OFF TICKETS

CROSS-REFERENCE TO RELATED APPLICATIONS

This application is a non-provisional application of U.S. 62/403,195 entitled "SYSTEM AND A METHOD FOR PLAYING NUMERICAL CARD GAMES" filed Oct. 2, 2016.

This application is a continuation-in-part Application, for which priority is claimed under 35 U.S.C. § 120, of copending U.S. patent application Ser. No. 14/332,351, filed Jul. 15, 2014, entitled "METHODS, SYSTEMS, AND APPARATUS FOR PLAYING POKER, BLACKJACK AND BACCARAT," which is a non-provisional Application, for which priority is claimed under 35 U.S.C. § 119, of U.S. Provisional Patent Application No. 61/846,608, filed Jul. 15, 2013, entitled "METHODS, SYSTEMS, AND APPARATUS FOR PLAYING POKER, BLACKJACK AND BACCARAT."

This application also is a continuation-in-part Application, for which priority is claimed under 35 U.S.C. § 120, of copending U.S. patent application Ser. No. 15/162,541, filed on May 23, 2016, entitled "METHODS, SYSTEMS, AND APPARATUS FOR PLAYING MULTI-ZONE 21, which is a non-provisional Application, for which priority is claimed under 35 U.S.C. § 119, of U.S. Provisional Patent Application No. 62/165,870, filed on May 22, 2015, entitled "METHODS, SYSTEMS, AND APPARATUS FOR PLAYING MULTI-ZONE 21, the entire contents of the above identified patent applications are hereby incorporated by reference in their entirety.

The entire contents of the above identified patent applications are hereby incorporated by reference in their entirety.

FIELD OF THE INVENTION

The present invention relates to an system and methods of playing multi-zone card wagering games and multi-zone twenty-one (21) with a numerical objective. These systems and methods can be played on a table apparatus, a lottery ticket or on an electronic visual display device.

BACKGROUND OF THE INVENTION

Card games are a staple of most casinos and played electronically on gaming devices or on client devices which communicate with servers over a network. U.S. Pat. No. 3,796,433 is an example of means of electronic blackjack. In blackjack, generally the objective is to get a twenty-one (21) value or have a value that is greater than the dealer.

In the prior art, card games can be played electronically, on a table or an electronic visual display device. Electronic card games includes machines and modules that include a computer having a microprocessor, memory, and storage. Electronic card games also typically include a housing having a display region that displays the results on a video display. Electronic card games are typically controlled by a processor with a random number generator (RNG) that communicates the variables to a stop position. Either (a) each symbol is determined by the processor using a random number generator or (b) the result is determined by the random number generator with the symbols determined afterwards.

In electronic gaming systems, after a player actuates the machine by selecting a wager and pulling a lever or pressing a button, the processor of the electronic gaming system turns the variables to a symbol or value that's in direct correspondence to the result from the RNG. If a player wins the game, a credit is added to the account of the player and is displayed on the machine.

Often in electronic gaming systems, the client devices are connected to a network with servers. These devices have computer-readable storage medium having retrievable code that is executable by a processor to cause the processor to perform operations including displaying the game and reading the characteristics of a game to determine whether or not the player of the game is a winner or loser.

In the prior art, a player wins casino electronic games by matching identical symbols sometimes with substitutes or wilds within a pay-line. In this casino slot type game, a player wins according to various lines and payouts from slots.

It is an object of the present invention to improve upon existing casino slot games and to provide more interesting and novel systems and methods for playing multi-zone twenty-one (21).

SUMMARY OF THE INVENTION

It is an object of the present invention to provide a system and method for playing multi-zone twenty-one (21) and other numerical casino games.

It is an object of the present invention to provide a system and method for playing multi-zone twenty-one (21) across an electronic gaming system, scratch off ticket, and at a casino table.

It is an object of the present invention to provide a scratch off ticket having the above characteristics that can be read by a scanner and instantly determined if the scratch off ticket is a winner.

These and other objects of the invention are achieved by providing an electronic gaming system for playing a multi-zone twenty-one, said system comprising: at least one display device; a wager input device that accepts vouchers and physical currency; a processor; and a controller programmed to control an electronic game of multi-zone twenty-one having three or more playing zones, the three or more playing zones displayed on the display device; wherein the wager input device allows a player an opportunity to select a wager amount to initiate the game, wherein, upon initiation of the game, cards are added to the three or more playing zones via the processor until the total value of the cards in each of the three or more zones is twenty-one (21) or greater than twenty-one (21), wherein a payout is awarded to the player via the processor if the player achieves a value of twenty-one (21) in at least 50 percent of the three or more zones, wherein there is a top payout if the player obtains twenty-one (21) in all of the zones in the multi-zone game, wherein the top payout is based upon an expected value based in part on the cumulative possibility of having a numerical value of twenty-one (21) in all the zones, wherein there is a subordinate payout of the player obtains twenty-one (21) in less than all of the zones in the multi-zone game, wherein the subordinate payout is based upon an expected value based in part on the cumulative possibility of having a numerical value of twenty-one (21) in a less quantity of the zones.

In certain embodiments, the player receives a subordinate payout if there are five cards in a zone that have an additive value of twenty-one (21) or less.

In certain embodiments, the wager input device is configured to accept real money or virtual money and is configured to accept a wager.

In certain embodiments, the system further comprises a user account, wherein the payout credits the user account of the player.

In certain embodiments, if the player achieves a value of twenty-one (21) in the all of the zones, the player receives a payment more than 100 times the wager.

In certain embodiments, the expected value if a player plays the game with an 11 is two.

In certain embodiments, the expected value is at least five if a player plays the game with a 12, 13, or 14 value.

Other objects of the invention are achieved by providing a printed scratch off lottery ticket for playing multi-zone twenty-one (21) comprising: a paper substrate having three or more playing zones, the three or more playing zones having three or more game spaces displayed on the paper substrate, the three or more games spaces of each of the three or more zones being covered by a scratch-off material; wherein upon playing of said game, a player removes said scratch-off material from said game spaces, and if the additive total of the three or more games spaces of each of the three or more zones is twenty-one (21), then the player is a winner, wherein the player receives a payout according to a pay table, such that the more zones the player wins, the higher the payout.

In certain embodiments, upon playing of said game, the player removes scratch-off material from a separate module that increases the payout of the zones by a multiple.

In certain embodiments, the three or more playing zones display indicia of that of a blackjack card playing deck.

In certain embodiments, there are eight zones.

In certain embodiments, there is a bonus card whereby the player has an additional chance of winning if the bonus card displays a twenty-one (21) value.

Other objects of the invention are achieved by providing an electronic system for validating a ticket for an electronic game of twenty-one (21), the electronic system comprising: a plurality of respective play modules of twenty-one (21) with at least four variables and a plurality of game operating variables, wherein if a plurality of the said variables match form a pre-determined numerical value the ticket validator from the memory stored in the processing unit validates the ticket a winner.

Other objects of the invention are achieved by providing a casino table monitoring system for an electronic game of twenty-one (21), the system comprising: at least one video camera for outputting images of objects at a casino table; a video interface for inputting the images from the at least one camera and processing the images into first game data; a game device comprising a rules module to track game states, said game device outputting game state and second game data; at least one monetary sensing system for obtaining and outputting monetary information at positions at the table; and a table manager unit for inputting the first and second game data, the game state data and the monetary information, said table manager unit determining if there have been any game anomalies based on the input data and monetary information.

In certain embodiments, the table manager unit associates each anomaly with a priority level and generates an alert on each anomaly and priority level.

In certain embodiments, the rules module comprises the following rules: if a player places chips in a specified area for a side bet for a one card objective, or if the next single card creates a twenty-one (21) value if the players hand is, 12, 13, 14, or 15, then the player would receive chips at least five times the players wager.

In certain embodiments, the table manager transmits to a central processing unit whether the dealer was correct in following the rules of the predetermined rules of the game.

Other objects of the invention are achieved by providing a method of monitoring a blackjack game in a casino, the method comprising: (a) capturing an initial calibration of a game environment background surface associated with an expected location of playing cards; (b) detecting through RFID or an image calibration if the amount of a players chips have been placed; (c) detecting through RFID or an image calibration if a player places a side bet that the next card will equal a twenty-one (21) value; (d) detecting by a computing device if the next card will create a twenty-one (21) value; (e) detecting through a computing device weather the dealer pays out the sidebet with a one card twenty-one (21); (f) sending the data to a central processing unit.

Other objects of the invention are achieved by providing a printed scratch off lottery ticket comprising: a paper substrate having three or more game spaces displayed on the paper substrate, the three or more games spaces being covered by a scratch-off material; wherein upon playing of said game, a player removes said scratch-off material from said game spaces, and if the additive total of the games spaces adds up to a predetermined numerical objective, then the player is a winner, wherein the player receives a payout according to a pay table.

Other objects of the invention and its particular features and advantages will become more apparent from consideration of the following drawings and accompanying detailed description. It should be understood that the detailed description and specific examples, while indicating the preferred embodiment of the invention, are intended for purposes of illustration only and are not intended to limit the scope of the invention.

DETAILED DESCRIPTION OF THE INVENTION

Figure 1A:
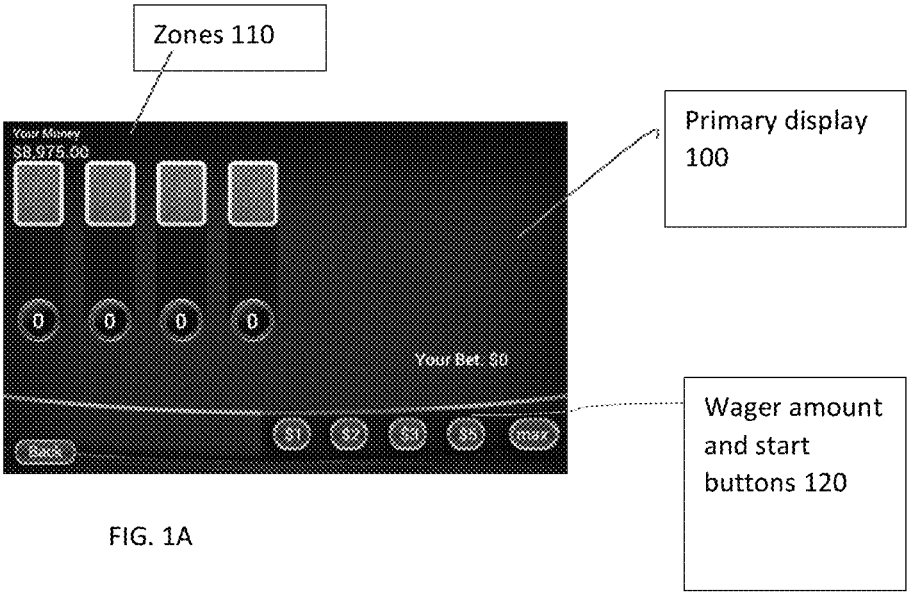
FIG. 1A is the primary display of a device displaying the multi-zone twenty-one (21) wagering game before game play begins for four zones for an exemplary embodiment of the game.

In the following description, numerous details are set forth for the purpose of explanation. However, one of ordinary skill in the art will realize that the invention may be practiced without the use of these specific details.

The present invention is directed to systems and methods for playing multi-zone twenty-one (21) and other numerical casino games.

In certain embodiments of the invention, systems are methods are provided for playing multi-zone twenty-one (21) across an electronic gaming system, scratch off ticket, and at a casino table.

In certain embodiments of the invention, a scratch off ticket having the above characteristics that can be read by a scanner and instantly determined if the scratch off ticket is a winner.

Electronic Game System

In an embodiment of the electronic game system, the player places a wager by inserting money and pressing a button actuator mounted on a display device. The objective of the game is to get exactly twenty-one or five cards with a twenty-one or under value in the maximum quantity of zones.

In certain embodiments, this game is housed in a cabinet there is a random number generator that communicates which variables to display. Either A) each symbol is determined by the processor using a random number generator or B) The result is determined by the random number generator with the symbols determined afterwards. After a player actuates the machine by selecting a wager and pulling a lever or pressing a button, the processor selects a value that's in direct correspondence to the result from the RNG. If a player wins the player is credited with the winning amount displayed on the machine in the display area, the player either withdraws the money or uses the credit to continue playing.

The gaming apparatus includes at least one processor, such as a microprocessor, a suitable integrated circuit or one or more application-specific integrated circuits (ASIC's). The processor is in communication with at least a memory data storage device. The memory portion of the apparatus the apparatus stores program code, executable by the processor, to control the gaming device. The memory device also stores, display data, player selection data, pay-table information and rules for the gaming apparatus.

A top prize or a high point value is awarded if a player achieves the said objective in all the zones. A subordinate prize or lower point value is awarded if a player reaches the said objective in a lesser number of zones. On the conclusion of the game the display device displays the randomly selected outcome. And a determination is made if a player has won or lost. If the player wins points are awarded the wager is resolved and a payout is awarded according to the pay table. The awarded points are cumulative as to the objective, a player can use the points to replay the game again or many times and is based on the probability of the future expected conditional value of receiving a 21 in the maximum amount of zones or P, with P−1 there are points awarded bases on the probability of having 21 the maximum amount of times less 1, and P−2 having 21 the maximum amount of times less two and p−3, p−4, p−5. P−6, p−7, etc. A player can also be awarded money instead of points.

Scratch Off Ticket

Another aspect of the present invention is to provide a scratch-off lottery game card with eight lines. The lottery game card includes a substrate, and a pay-table. The game indicia are initially covered by a removable material. After a player purchases the ticket the material is removed.

If the game symbols identified by the game indicia form the predefined numerical objective twenty-one (21) in all the lines a top prize or top amount of points is awarded to a player holding the lottery game card. If a player has twenty-one (21) in a lesser amount of lines a subordinate prizes or points are awarded. The points will enable a player to play the game again or multiple times. There is also a readable security code printed on each ticket being covered by scratch-off material.

In an embodiment of a scratch-off lottery game, the player purchases a pre-printed scratch-off game card with some areas covered by a removable material. The player scratches off at least some of the removable material, if the scratched areas reveal an outcome favorable to the rules of the game a prize is awarded. There is an area beneath the scratch off material that verifies to a teller (a) if a ticket is a winner or loser and (b) the amount of payment the player is to be awarded.

Scratch Off Ticket (House Cards)

In a certain embodiment, the lottery scratch card game card includes five lines "house cards" initially covered by a translucent removable material and another area "your cards" initially covered by a removable opaque material. A player scratches the "your cards area" then scratches the corresponding "house cards". If the numerical value of the corresponding "house cards" within a line add up to a value that is exactly twenty-one (21) a prize amount or point value that is adjacent to the said line is awarded to the player holding the lottery game card the points will enable a player to play the game once or a multiple amount of times.

In another embodiment, there is a plurality of "play area" parameters and a plurality of "game numbers". If the variables within the play areas add up to a "game number", the prize value beneath the play area is awarded to the player or a player gets points. The ticket is at least partially covered by a removable material. There is also a readable security code printed on each ticket being covered by scratch-off material.

Improved Blackjack

In another embodiment disclosed herein, a blackjack table game apparatus with a "one card 21" side bet is provided. In this embodiment, a player has the option of betting that a single card will create a hand that is exactly a twenty-one (21) value. After the dealer's hand is dealt and the player receives the face up cards a player places the casino chip(s) in the area marked "one card 21".

There is a payable that explains the payouts; if a player has an eleven value the house will pay two to one if the next card is a 10 value, if a player has a ten, or twelve to sixteen value the house will pay ten to one if a single card creates a value that is exactly 21.

If a player has 17 or more and they placed the "one card 21" side bet the house will pay 12 to one. If the house wanted to increase their edge they can add that "hands must be hard to qualify" a hard hand is hand that does not contain an ace being counted as an eleven value. It can be appreciated that this is a side bet and not a mandatory part of the game. This game can also be played on an electronically visual display and the instructions executed through an electronic storage medium and central processing unit.

Electronic Verification

The scratch off tickets in these games can be validated with a remote terminal. After the ticket identifying mark "prize check" scratched a player scans it to a remote terminal connected to a central processor that would validate the authenticity of the ticket and retrieve information from memory stored from the data in a lottery database. Information on the ticket can also be stored locally or accessible over a network. The controller of a lottery terminal can be programmed to pay, authorize the payment of, or indicate an award (i.e., a $20 winner on the screen") that corresponds to the player's point value once verified. Once a ticket is validated there is a payout responsive to the wining amount and it is relayed back to the central processing unit that the winning amount has been paid so a player cannot go to another terminal and cash it a second time.

In certain embodiments, the electronic verification provided also includes security verification, and various types of encryption to protect against authorized winnings of tickets.

Video Monitoring System

In certain embodiments, the system also includes a video monitoring system such that table games of twenty-one (21) and blackjack are able to be monitored by a casino.

In certain embodiments, the system includes at least one video camera, monitor and processor so that the games are able to be monitored.

Exemplary Embodiments Shown in Figures

Figure 1B:
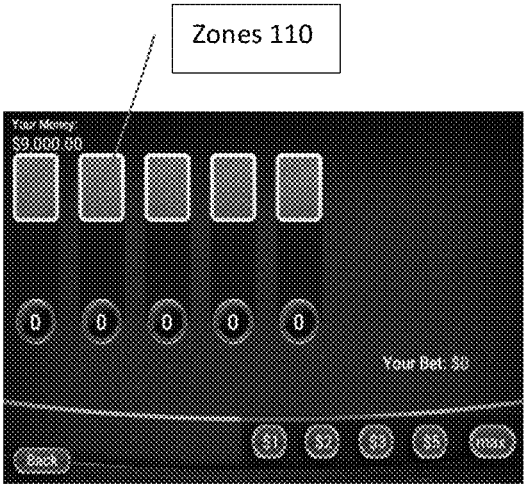
FIG. 1B is the primary display of a device displaying the multi-zone twenty-one (21) wagering game before game play begins for five zones for an exemplary embodiment of the game.
Figure 1C:
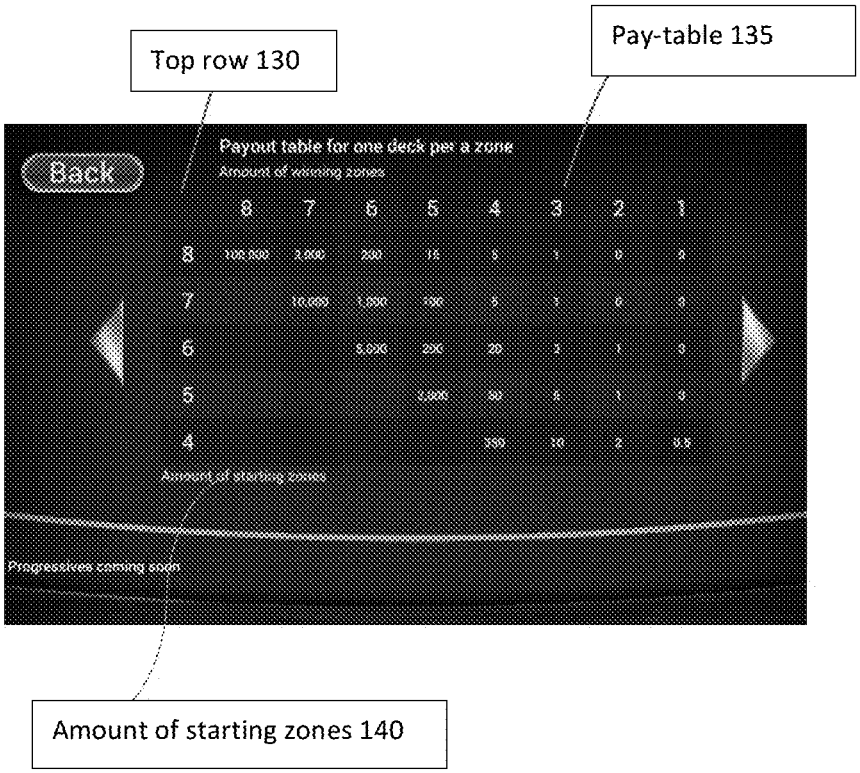
FIG. 1C is an illustration of a pay table for the game illustrated in FIG. 1A and FIG. 1B.

FIG. 1A to FIG. 1C discloses a zone module 100, a bet module 120 and a payout module 135 on a display area 100. FIG. 1A illustrates a screenshot showing of a primary display 100 of a device (system). Further, the screenshot displays a multi-zone blackjack wagering game before the game play begins for four zones 110 in an embodiment of the present invention. The system includes a database and a processing unit (not shown). The primary display 100 comprises various modules such as zone module 110 and bet module 120 as shown in FIG. 1A.

FIG. 1B is the primary display of a system for five zones 110 before game begins in an embodiment of the present invention. The display device may be a free-standing gaming machine or a personalized computer device. The bet module 120 displays buttons to indicate the wager or point sacrifice 1, 2, 3, 5 and Max. The Max button allows the user to bet $5 or 5 points or the maximum amount allowed by the casino wagering machine. There is also a win or loss area that shows on a display the amount that was won or if a player lost. The winning amount is credited to a payers account on the upper left side of the screen.

The buttons of the bet module 120 in this embodiment are on the screen and touch activated however they may also be located off the screen and push activated. In order to begin the game a player receives points or credit, the credit could be money deposited through a credit card or cash inserted into a gaming machine.

FIG. 1C discloses a payout module that indicates the payout 135 or point distribution for the game. For exemplary purposes, the game is twenty-one (21) or could also be blackjack or another card game. P is the highest objective (top objective) and P-X a subordinate objective to be achieved. The payout module 135 calculation for the game in FIG. 1A is based on the cumulative statistical probability of getting 4\4 21 P expected value, 3\4, 21 P−1 expected value, 2\4 21 P−2 expected value, and 1\4 21 P−3 expected value. The payout or point module 135 rewards users cumulatively on deals based on the results from the zone module 110.

The columns with the number of starting zones 140 indicate the initial starting zone quantity selected. In FIG. 1A, there are four zones 110 and in FIG. 1B there are five zones 110. The top row "amount of winning zones" 130 indicates the payout or points if a player won the said quantity of zones 110. The payouts 135 or points increase substantially with the top payout being at least a hundred, and may also be more than one-thousand or more than that of the bottom payout or points. Points can be used to play the game again or a multiple of times.

Figure 1D:
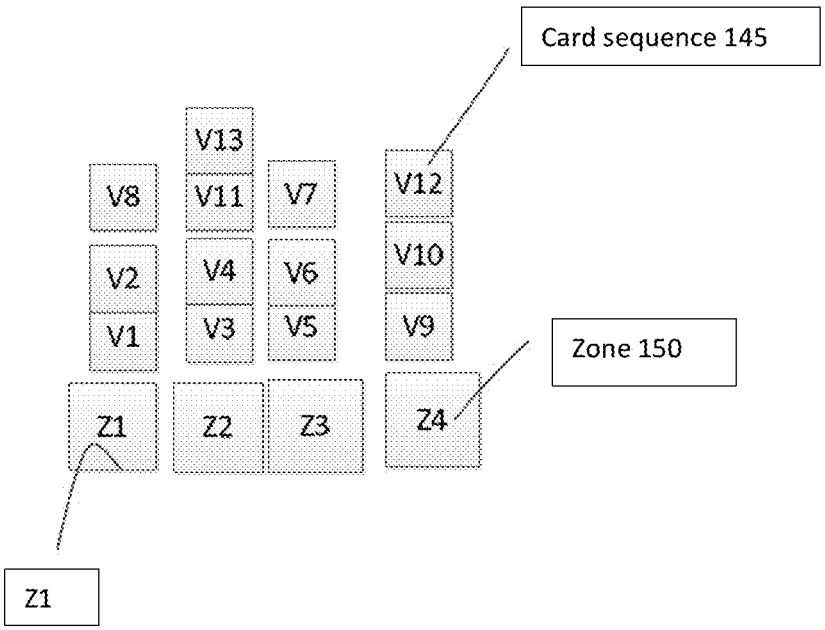
FIG. 1D is an illustration of the sequence of cards as displayed on the primary display device for FIG. 1A.

FIG. 1D illustrates a visual sequence for game in FIG. 1. To begin the game a player presses a wager button 120 from the bet modules $1, 2, 3, 5 or max. The gaming operator then deals the cards. The cards may be dealt in each zone either in sequence or non-sequentially. The letter V illustrates a possible order of a visual sequence, and Z represents each zone 110 as a player sees it on the screen. The objective of a non-sequential sequence is to captivate the player's attention during game play as it will appear to the player to be near simultaneous.

Figure 1E:
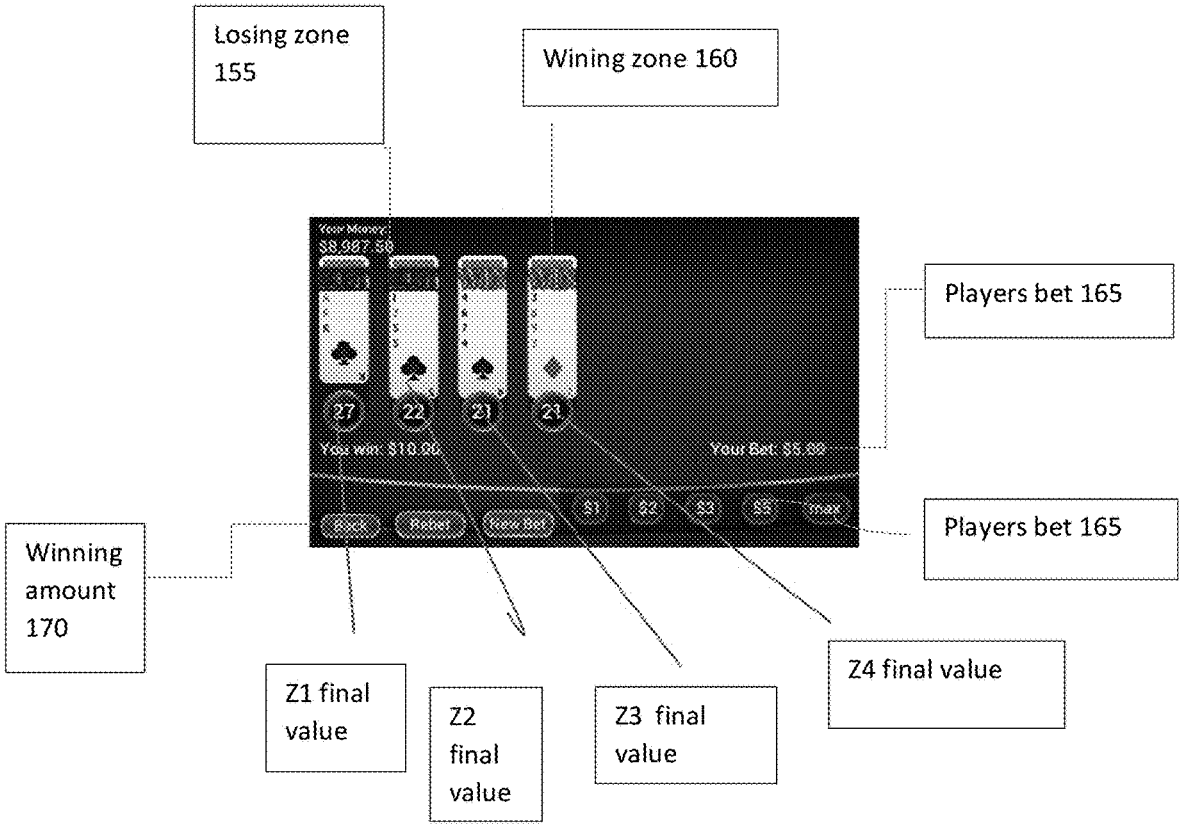
FIG. 1E is an illustration of the conclusion of the game embodiment of FIG. 1A.

FIG. 1E illustrates a screenshot of the game played out to its conclusion. A player selected "$5" or max and 4 zones 110. The total value for Z1 is 27 hence a loss for that zone 155, for Z2 the total value is 22 another loss, for Z3 and Z4 the values are both 21, wins. The gaming operator resolves the wager and a player receives a total payout of $10 or points. Though, the objective is generally for the player to reach 21 in as many zones as possible, the gaming operator may award payouts or points to the player if a zone value is 21 or less within five cards or if a player receives some other bonus criteria.

Figure 1F:
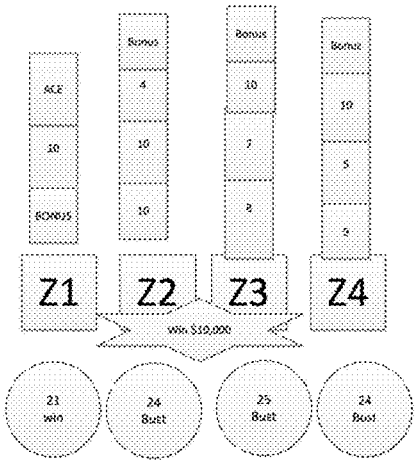
FIG. 1F is an illustration of an exemplary embodiment of the game played with bonuses.

FIG. 1F illustrates an alternative embodiment played out to its conclusion. This is a "twenty-one (21)" themed game. In this embodiment there are 4 zones, however there also may be five or six. In three of the zones a player did not obtain 21 values however the player received a bonus card in all the zones. Hence a winning amount of $10,000 or points is displayed on the win module area.

Figure 2A:
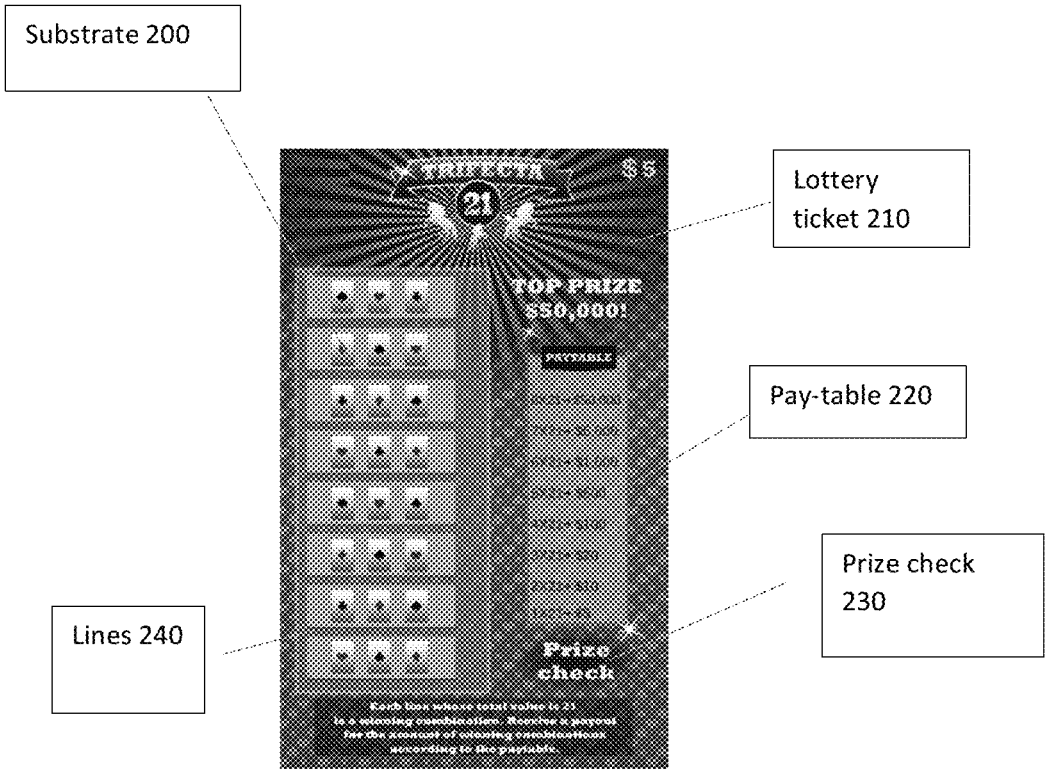
FIG. 2A illustrates an exemplary scratch off game.
Figure 2B:
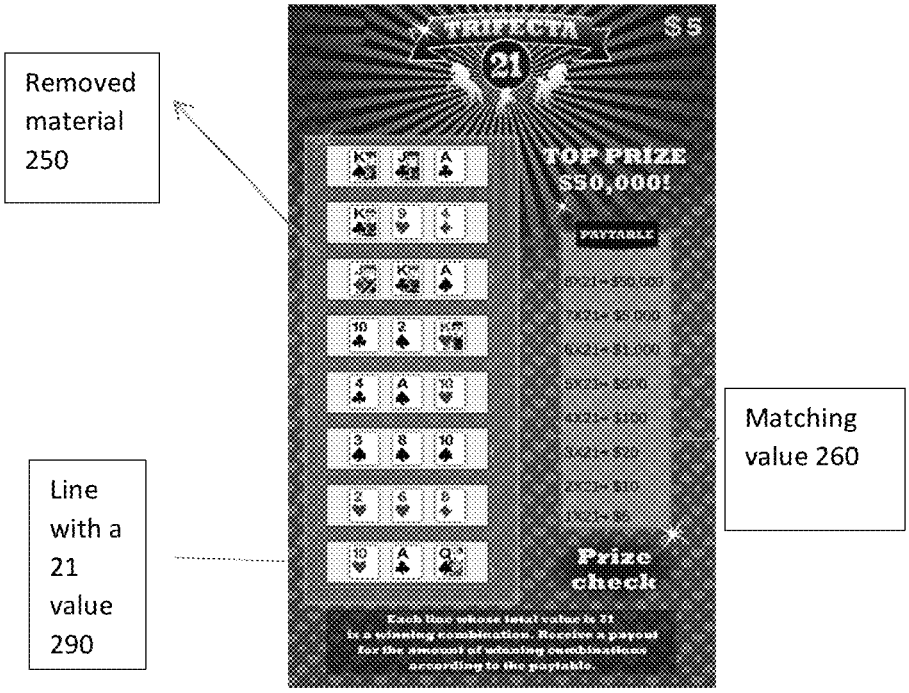
FIG. 2B illustrates the scratch off game of 2A where the game area has been scratched off by the player.

FIGS. 2A and 2B depict a, scratch-off, pull-tab lotto ticket 210. On the left side, there are eight separate rows initially covered by a removable material 200. After a player purchases the ticket the scratch off material is removed; the objective of the game is for a player to reach the numerical value "21" in each line 240. In this game the King, queen and jack represent a ten value and the Ace is a flexible value that is a one or eleven.

With each line that contains a twenty-one (21) value the prize or points amount increases progressively according to the pay-table 220 on the right side. FIG. 2B is a ticket where the substrate material over the eight lines has been removed. The player ads up the value within each line; the first, third, fifth, and eighth line contains a twenty-one (21) value, four lines with a winning value. Thus, according to the pay table, the player wins $100 or points. The "prize check" is used for verification on a gaming apparatus or terminal which displays the won amount or points or monetary value on a display apparatus.

Figure 2C:
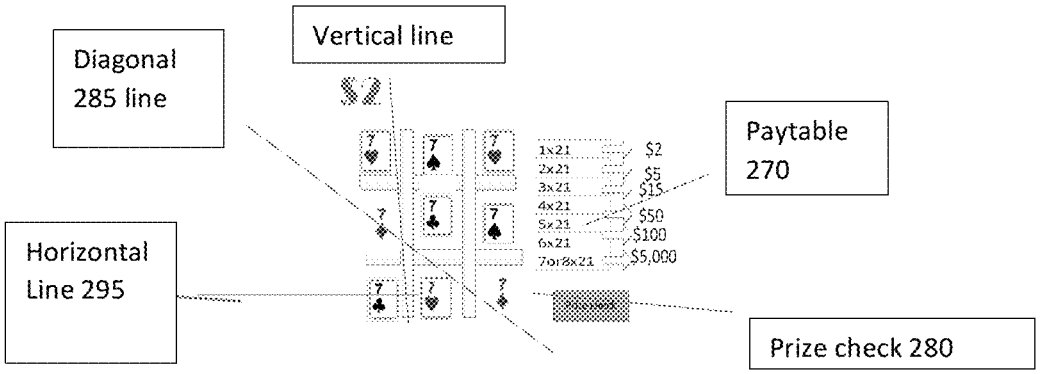
FIG. 2C illustrates an exemplary scratch off ticket embodiment.

FIG. 2C is an exemplary illustration of a lottery-scratch game with the substrate 250 removed from the play area. The rules of the game are as following: if a player has a twenty-one (21) value in at least a line 290; a horizontal, vertical or diagonal line the player receives a prize or points according to the pay-table. In the scratch off ticket shown, a player has a twenty-one (21) value in all lines. a player takes the ticket to a lottery terminal using "prize check" 280 to verify the ticket and an award associated with the point value.

Figure 3A:
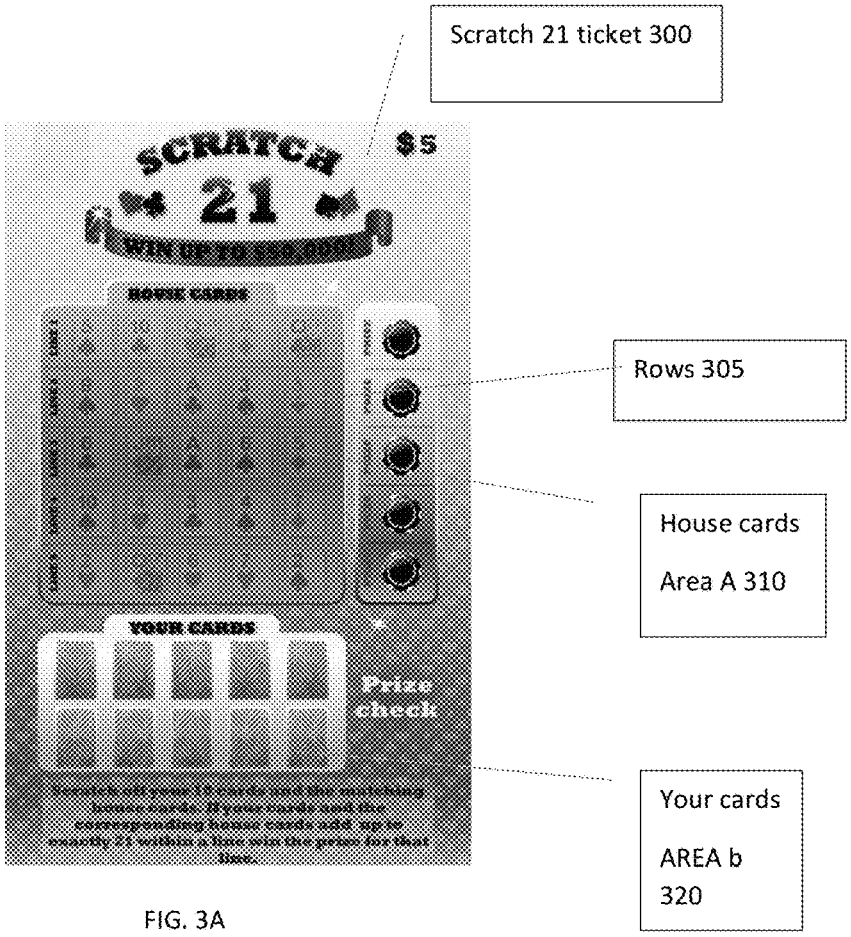
FIG. 3A illustrates the scratch off ticket "Scratch 21"
Figure 3B:
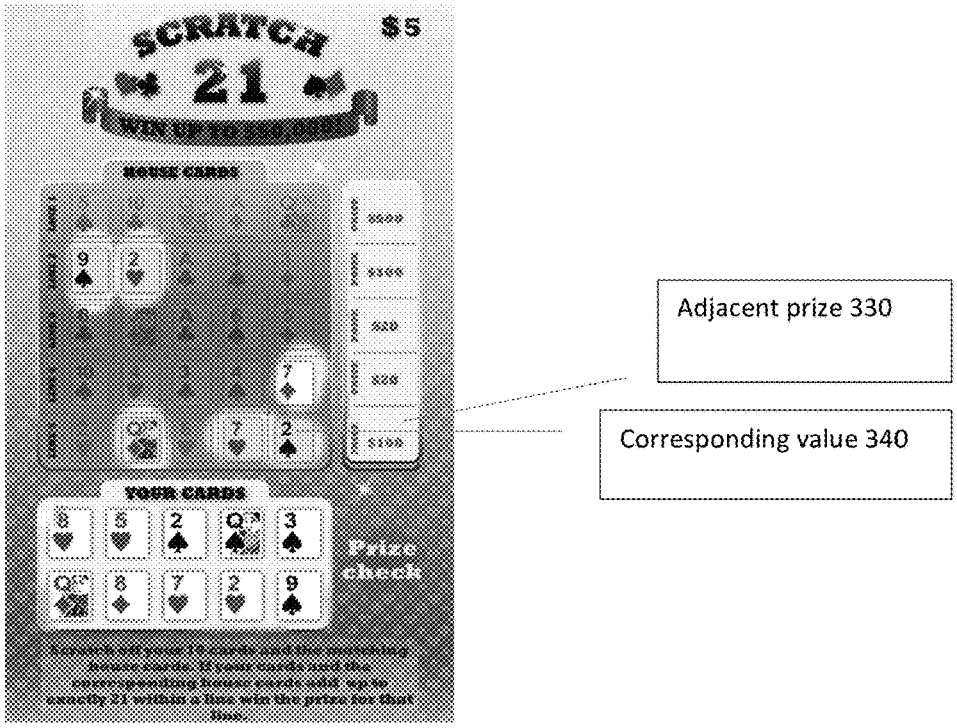
FIG. 3B illustrates the scratch off ticket of FIG. 3A with the "your cards" area scratched off and the prize area and corresponding "house cards" scratched off.

FIGS. 3A and 3B illustrates another exemplary embodiment titled "Scratch 21". FIG. 3A is an embodiment with the scratch-off/swipe material un-removed from the ticket 300. In the "house cards" section 310 there are five rows 305 each containing card values covered by a translucent material and adjacent on right side of each line is a prize amount or point value covered by an opaque material.

At the lower part of the ticket are player's numerical cards 320 that are covered by an opaque material. A player purchases the ticket 300 from a retailer or uses points (such as in an electronic version of the scratch ticket) then scratches the area marked "your cards" then the player scratches the identical corresponding translucent indicia within "house cards" as illustrated in FIG. 2B. If a line contains exactly a twenty-one (21) value, points are awarded a prize associated with the points is awarded to the ticket holder and with the points a player can use that to play a new game.

In FIG. 3B, the player scratched the area marked "your cards" the corresponding "house cards" and corresponding prizes. The corresponding "house cards" in the bottom line contains a twenty-one (21) value, hence the player wins the adjacent prize 330 of "$100". "Prize check" is used for verification and if a player wins a player receives an associated point amount 340 and a dollar value associated with the point amount appears on the terminal.

Figure 4A:
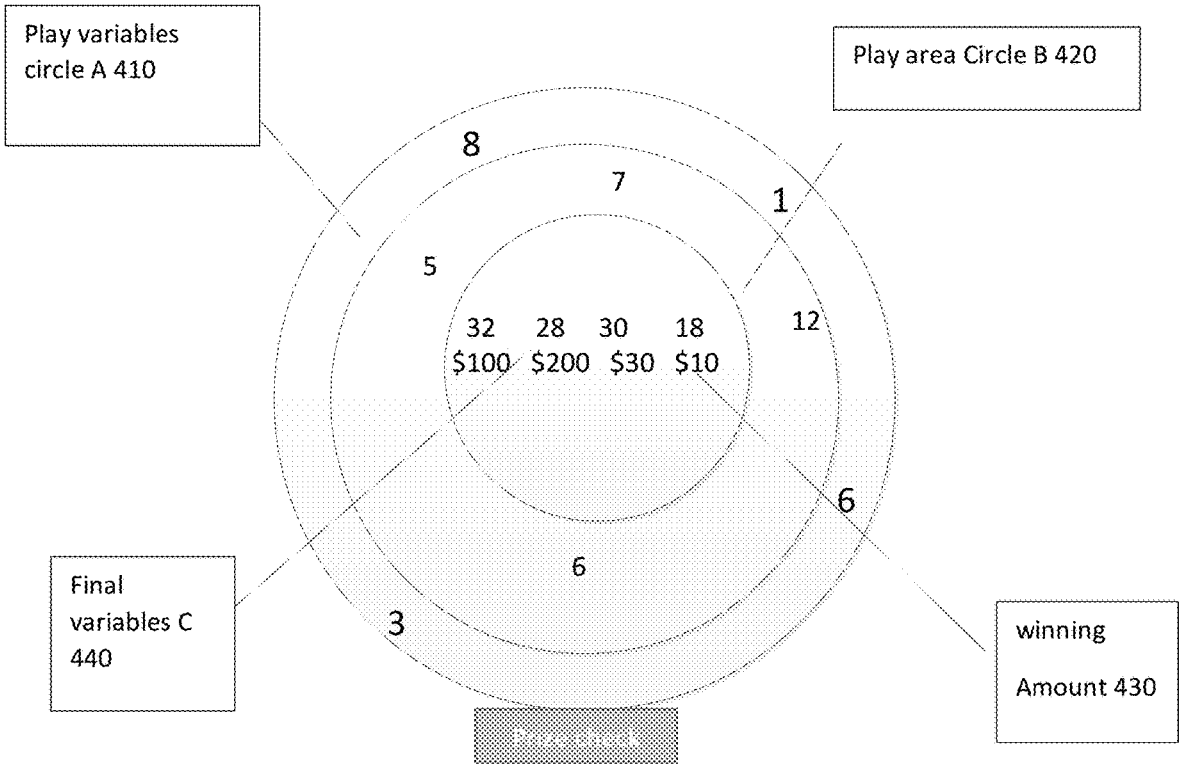
FIG. 4A illustrates an exemplarity embodiment scratch off ticket with a non-twenty-one objective.

FIG. 4A illustrates an exemplary scratch off game card with the substrate removed. A player is a provided with a scratch off ticket there are three variable sets. Two "Play variables" parameters and one "final variables" indicia. The play variables 410, 420 are in circle A {8, 3, 6, 1} and circle B {5, 7, 12, 6} and there are final variables C 440 {32, 28, 30 and 18} and beneath each of the final variables is a potential prize amount {$100, $200, 30, and $10}.

If the players variables in A or B add up to a number within the "final variable", the winning amount 430 or point value beneath the said variable(s) is awarded to the player holding the scratch-off ticket. On this ticket, the total numerical value in circle A is 18, in circle B the total numerical value is 30. A player is awarded the prize beneath the 30 "$30" and the prize beneath the 18 "$10" a total prize of $40. "Prize check" is used to verify with a central processing unit if a ticket is a winner and the amount to be paid out.

Figure 4B:
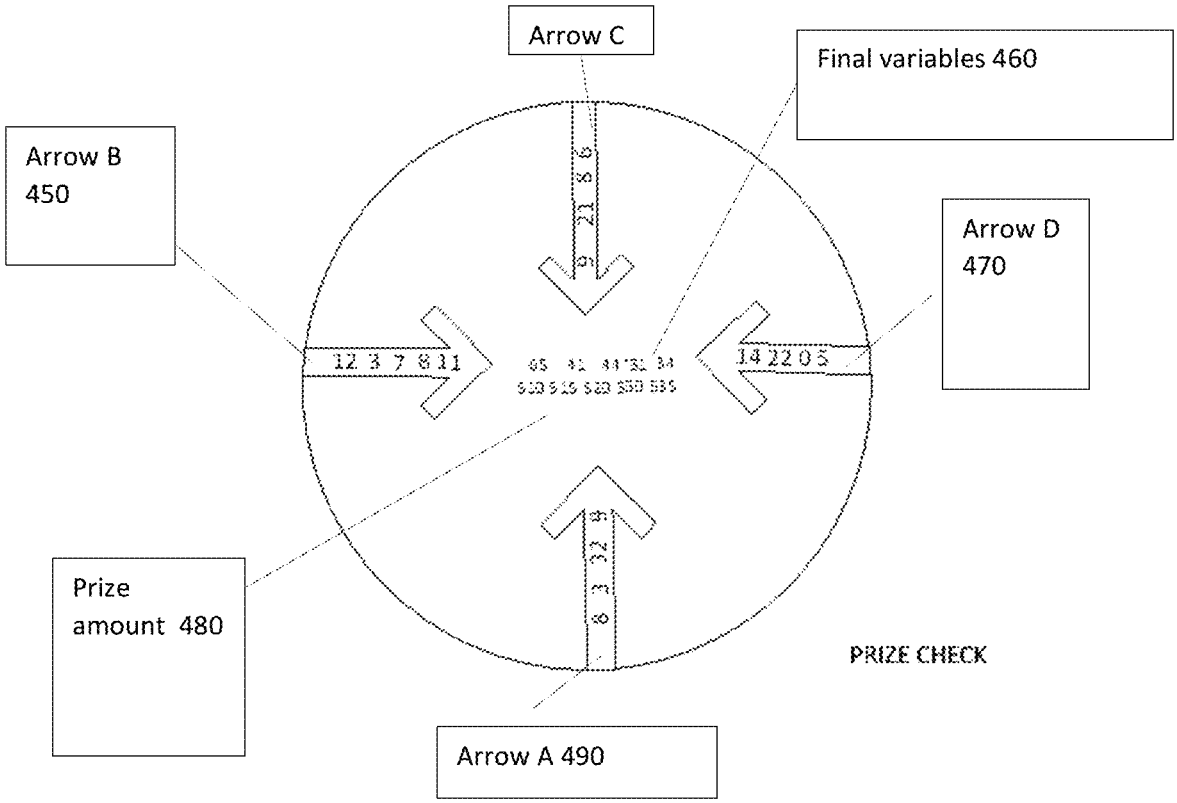
FIG. 4B illustrates another exemplarity variation scratch off ticket with a non-twenty-one objective.

FIG. 4B illustrates another embodiment variation of a scratch off game card with the substrate removed from the play area. There are four arrows within a circle each containing play variables: A 490 {8, 3, 32, 9}; B 450{12, 3, 7, 8, 11}; C 455 {9, 21, 8, 6}; and D 470 {14, 22, 0, 5}.

If any of those arrows add up to any of the final variables {65, 41, 44, 31, 34}, then a player is awarded the prize or associated points beneath those variables {$10, $15, $20, $30, $35} respectively. In arrow B 450, the numerical value is 41 and in arrow C the numerical value is 44. The prize beneath those two amounts in the game area is $15 and $20. The prize amount quantity is $35. A player uses prize check for verification.

Figure 5:
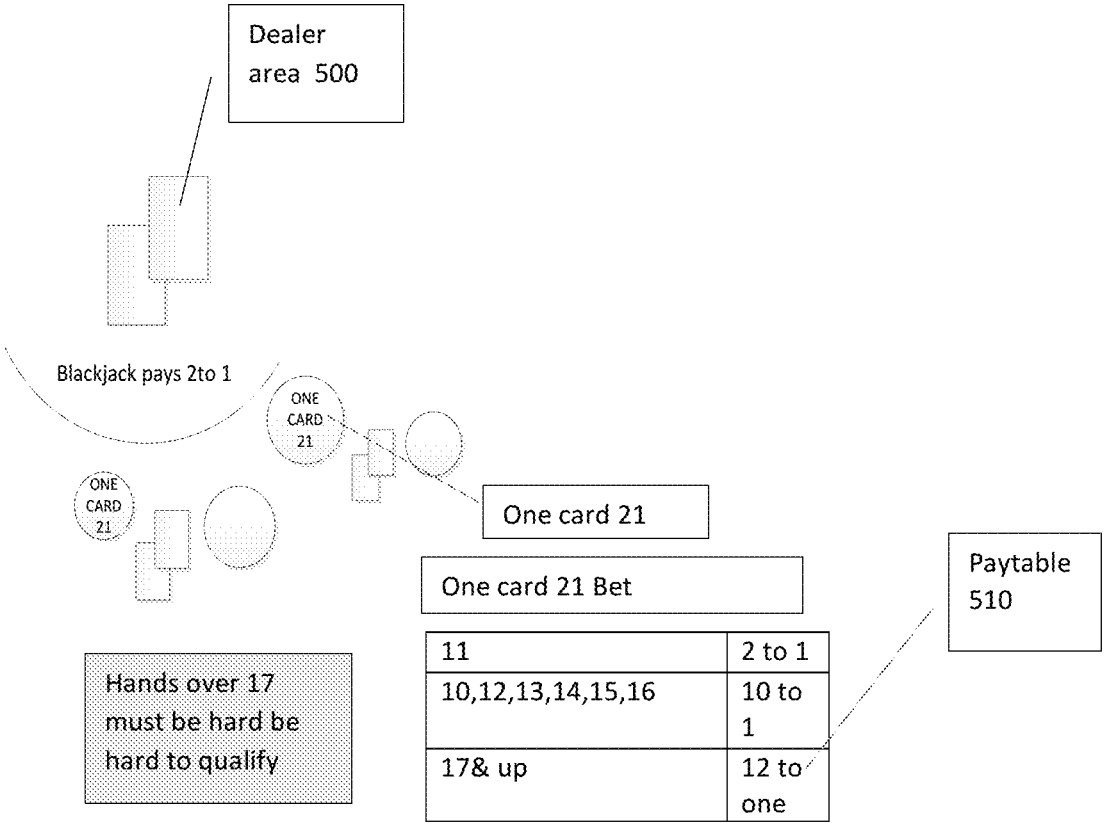
FIG. 5 depicts an exemplary embodiment of a blackjack card table game with a "one card 21" side bet.

FIG. 5 illustrates a blackjack table game apparatus with a "One Card 21" side bet. In this embodiment, a player has the option of betting or sacrificing an associated point value that the next card dealt will create a hand value that is exactly twenty-one (21). After the dealer's hand is dealt and the player receives face up cards a player places their casino chip(s) in the area marked "one card 21".

There is a payable indicator that contains indicia that explains the expected conditional value that must be followed by the dealer; if a player has an eleven value there is an indicator that the players expected value is two to one if the player's next card is a 10 value. If a player hand has numerical value of ten, twelve, thirteen, fourteen, fifteen or sixteen the apparatus indicator sates the expected value will be ten to one if the next single card creates a value that is exactly twenty-one (21). If a player has 17 or more and the next card dealt creates twenty-one (21) value the house will pay 12 to one.

If the house wanted to further increase their edge the following indications could be added to the apparatus 1) "Hands over 17 must be hard to qualify" for the high expected conditional value indicator of 12 to one. A hard hand is hand that does not contain an ace being counted as an eleven value. This game may be played with a point system using casino currency that utilizes a security feature to verify the said currency using an electronic processing unit. This game may further be played on an electronically visual display device with a random number generator (RNG) like the aforementioned games it can use a virtual dealer or a live dealer with an electronic detecting system designed to detect the cards, the detecting system being in data communication connectivity with a processor and the processor is configured to determine a specific card value. If a player wins, the screen apparatus displays the amount won in association with a point value or a monetary value.

Figure 6:
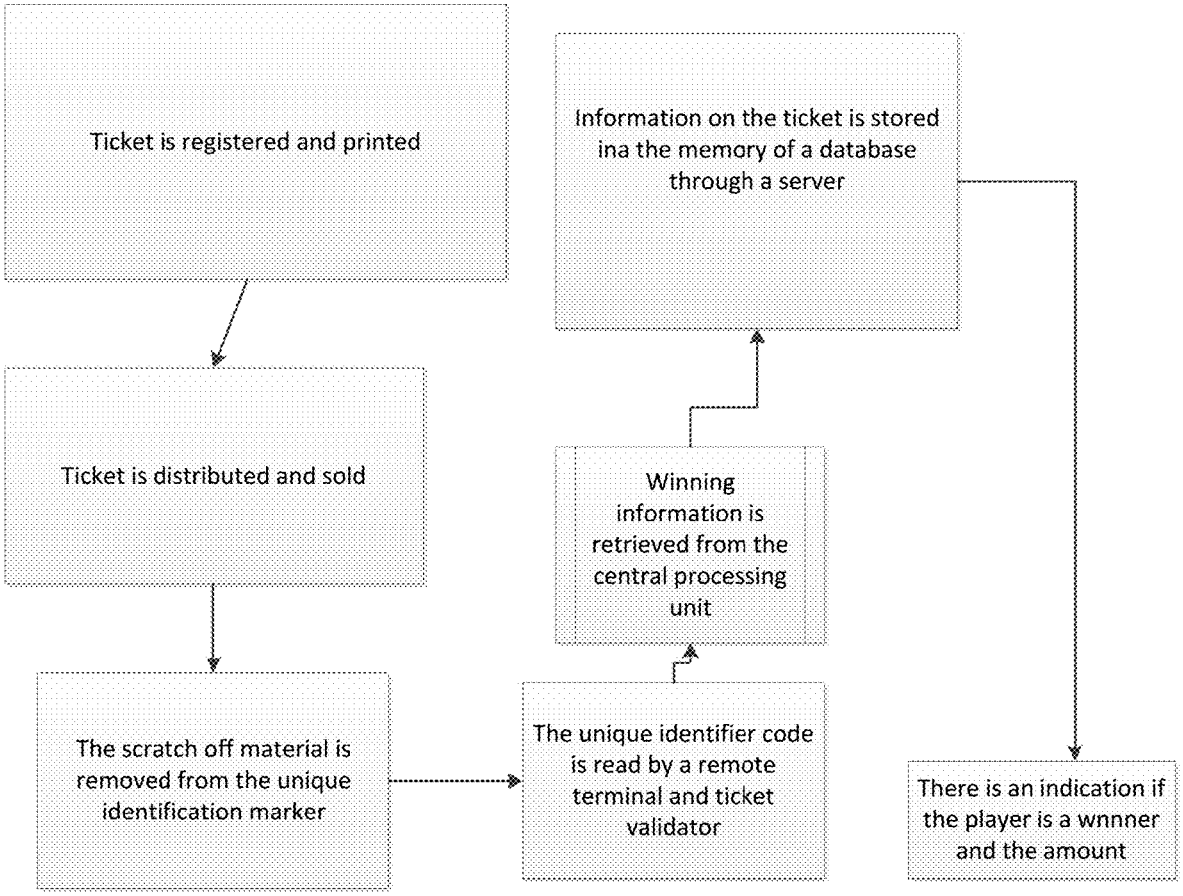
FIG. 6 depicts a flow chart of the scratch off lottery scratch off system.

FIG. 6 is a flow chart 600 as to how the scratch-off lottery system works. A ticket is printed with a unique identification printed on the ticket and registered in a central database. In this application, the unique marker is represented by "prize check". There is a database that stores the information for the tickets on memory on a database server network. After the prize check or unique identification marker scratch material is removed the ticket is scanned or read through a remote terminal connected to a lottery database. The scanner establishes the validity of the ticket and issues an indication on the terminal weather the ticket is a winner or loser and the amount of the winning ticket. Once a ticket is validated there is a payout responsive to the wining amount and it is relayed back to the central processing unit that the winning amount has been paid so a player cannot go to another terminal and cash it a second time.

Other Embodiments of the Invention

Other embodiments of the invention are directed to a system for playing a virtual card game, said system comprising: a wager input device; a database for storing data related to virtual card game; a processing unit couple to the database further comprising: an actuator to actuate a bet, a bet module for allowing users to place wager to initiate the game, a zone module to deal the plurality of cards from plurality of zones on receiving the wager from the user, on dealing revealing the final numerical value of each zone; and a payout module for indicating a winner. In this embodiment, the processor makes a determination whether:

A) There is a top winner for a player obtaining 21 in a maximum number of zones Z with an expected value based in part on the cumulative possibility of having variables with an additive numerical value of 21 in all the zones;

B) There is a subordinate winner for obtaining 21 in a lesser quantity of zones. Z-x with the expected value based on having a lesser quantity zones C) A player is not a winner.

In certain embodiments, the account information is updated on the visual display device.

In certain embodiments, a player is a winner if there are five cards in a module that have an additive value of 21 or less.

In certain embodiments, a player wins if there are a plurality of non-playing card variables within the game.

In other embodiments, a printed scratch off lottery ticket is provided, comprising: a substrate covering game variables and a prize check. In this embodiments, the scratch off ticket includes a plurality of game with at least three respective modules with at least three spaces for variables, wherein upon playing of said game, a player removes said scratch-off material from said game spaces and said player game indicia, and if a game space position(s) form a pre-determined additive value the player is a winner, wherein upon playing of said game, a player removes scratch-off material from a separate module, and if an additional module(s) form an additive numerical value the points or award is substantially higher than as if each module was won separately.

In certain embodiments, the prize check feature would validate a player a winner with a higher expected win value by retrieving the information from a central processing unit.

In certain embodiments, an additive numerical value is 21.

In certain embodiments, the game indicia are that of a blackjack playing card deck.

In certain embodiments, there are eight lines.

In certain embodiments, there is a bonus card whereby a player can have an additional chance of winning.

In other embodiments, a printed lottery ticket is provided comprising: a plurality of separate game modules with three spaces for variables in each module, the indicia are that of a playing card deck, wherein upon playing of said game the additive value within a module is 21 a player wins the game. In certain embodiments, there is prize check that can be read by a central processor that can validate the prize.

In certain embodiments, there are eight modules.

In other embodiments, a printed scratch off lottery ticket with a prize check validator is provided comprising: a plurality of respective play modules with at least three variables and a plurality of game operating variables, wherein if a plurality of the said variables match to the gaming variables within a module and the matched variables together form a pre-determined additive numerical value the ticket validator from the memory stored in the processing unit would validate the ticket a winner.

In certain embodiments, the additive numerical value needed to be formed is 21.

In certain embodiments, the values are that of a blackjack playing card deck.

In other embodiments, a printed scratch off lottery ticket with a prize check validator is provided comprising: a plurality of respective play modules with at least four variables and a plurality of game operating variables, wherein if a plurality of the said variables match form a pre-determined numerical value the ticket validator from the memory stored in the processing unit would validate the ticket a winner.

In certain embodiments, the numerical value is 21.

In certain embodiments, the values are that of a blackjack playing card deck.

In other embodiments, a blackjack table apparatus is provided comprising: an area for the dealer's cards; an area for the player's cards; and an expected value indicator for determining a value if a player plays a side game within the game with the objective of receiving a 21 value with a single card.

In certain embodiments, the indicator is printed.

In certain embodiments, the indicator is digitalized.

In certain embodiments, the expected value indicator if a player selects the game is two to one if the player plays the game with an eleven value.

In certain embodiments, the expected conditional value indicator is at least five to one if a player plays the game with a 12, 13, or 14 value.

In other embodiments, a gaming system is provided comprising: at least one display device; at least one processor; and at least one memory device which stores a plurality of instructions, which when executed by the at least one processor, cause the at least one processor to: (a) display on the at least one display device, a player interface having a table blackjack visual representation with at least a player area and a dealer area from a "playing card" deck and at least one pay-out-line, the at least a win actuation result location; (b) upon actuation, update the actuation locations on the at least one display device based at least in part upon the output of a randomized card generator least one rule set; (c) a rule set based on a calculation after the at least two cards of a players hand are visible a win calculation based on the excepted value probability of reaching the 21 objective with a single card; and (d) update an account based upon the win.

In certain embodiments, the expected conditional value win if a player plays the game with an 11 is Two.

In certain embodiments, the expected value indicator is at least Five if a player plays the game with a 12, 13, or 14 value.

In other embodiments, a blackjack and twenty-one gaming system is provided where every single move is tracked by computers and by a security system. In certain embodiments, there is a central processing unit, a database and a storage which stores and tracks all the moves in the blackjack and twenty-one gaming system.

In certain embodiments, this system is also tied to a live table game whereby where every single move is tracked by computers and by a security system. In certain embodiments sensors and cameras are employed that read information and convey information to a processor, database and storage to track the information.

Having thus described several embodiments for practicing the inventive method, its advantages and objectives can be easily understood. Variations from the description above may and can be made by one skilled in the art without departing from the scope of the invention.

Accordingly, this invention is not to be limited by the embodiments as described, which are given by way of example only and not by way of limitation.

What is claimed is:

1. A scratch off lottery ticket comprising:

a printed ticket with a physical substrate at least in part covered with a removable scratch off material, the substrate comprising a play area, a match area, and a prize check;

the play area comprises at least four separate game spaces in each of a plurality of play area zones, each game space is comprised of an indicia;

the match area comprises a plurality of separate game spaces, each game space is comprised of an indicia;

wherein the indicia in the play area that matches one or more indicia of the match area is operable to the play area zone, wherein a numerical value of each indicia is determined from of a multi-plurality of numerical values, wherein if the additive numerical value of the at least four separate game spaces in each of the plurality of play area zones is equal to a predetermined numerical value in one of the plurality of play area zones, then the prize check indicates that the ticket is a winner.

2. The scratch off lottery ticket of claim 1, wherein there are at least ten game spaces in the match area and at least ten game spaces in the play area, wherein if any of the indicia in the play area matches any of the indicia in the match area, then the indicia is operable to the zone.

3. The scratch off lottery ticket of claim 1, wherein a play area zone comprises a first game space, a second game space, a third game space, a fourth game space, and a fifth game space, and wherein if the additive numerical value of the operable indicia within a play area zone coincides with a predetermined numerical objective value, then the prize check indicates that the ticket is a winner.

4. The scratch off lottery ticket of claim 1, wherein the game spaces in the play area and the match area are at least in part covered by scratch off material.

5. The scratch off lottery ticket of claim 1, wherein the prize check is determined via a lottery terminal.

6. A scratch off lottery ticket, comprising:

a printed ticket with a physical substrate at least in part covered with a removable scratch off material, the substrate comprising a play area, a pay-table and a prize check, the play area comprises a plurality of zones, each zone has at least three game spaces, each space being comprised of an indicia, wherein the numerical value of each numerical indicia is determined from of a multi-plurality of non-zero values, wherein the indicia in the plurality of zones is operable only in a single zone, wherein if the numerical value summation of a first zone, a second zone, a third zone, and a fourth zone coincide with a predetermined numerical value, a point value is assigned to the zone;

wherein the point values of the operable zones are combined, and wherein the prize check identifies the ticket as a winner if the point value coincides with a point value that corresponds to a monetary value on the pay-table.

7. The scratch off lottery ticket of claim 6, wherein the scratch off ticket contains at least ten game spaces in the play area.

8. The scratch off lottery ticket of claim 6, wherein the scratch-off ticket further comprises a fifth zone, each zone has at least three game spaces comprising of indicia, each game indicia being specific only to that zone, wherein the numerical value of each numerical indicia is determined from of a plurality of non-zero values.

9. The scratch off lottery ticket of claim 8, wherein the scratch off ticket further comprises a sixth, a seventh, and an eighth zone.

10. The scratch off lottery ticket of claim 6, wherein the payout amount in the pay-table increases progressively as the point value increases.

11. A scratch off lottery ticket comprising:

a printed ticket with a physical substrate at least in part covered with a removable scratch off material, a play area, and a prize check;

the play area comprises a plurality of zones, each zone containing a plurality of separate game spaces, each space being comprised of an indicia, a match area, the match area comprising a plurality of games spaces, each space contains an indicia, wherein the indicia of the play area are only operable if it coincides with a match area indicia wherein the value of the indicia is determined from a multi-plurality of non-zero values, wherein if the additive numerical values of a first indicia, a second indicia, a third indicia, and a fourth indicia in a zone form a predetermined numerical objective value, then the prize check identifies the ticket as a winner.

12. The scratch off lottery ticket of claim 11, wherein if the additive numerical values of the first indicia, the second indicia, the third indicia, the fourth indicia, and a fifth indicia form a predetermined numerical objective value, then the prize check identifies the ticket as a winner.

13. The scratch of lottery ticket of claim 11, wherein each zone corresponds to a separate winning amount.

14. The scratch of lottery ticket of claim 11, wherein if a plurality of zones final value coincides with the predetermined numerical objective value in the plurality of zones, a display device via the prize check displays an amount that is at least the combination of winning the two separate corresponding zones.

15. The scratch off lottery ticket of claim 14, wherein there are a plurality of different predetermined numerical objective final variable values and if the additive values in a zone coincide with at least one final value objective value, the prize check identifies the ticket as a winner.

16. The scratch off lottery ticket of claim 14, wherein a payout is determined according to a pay-table, such that the more zones the player wins, the higher the payout.

17. The scratch of lottery ticket of claim 11, wherein the indicia in the game spaces are numerical indicia and the value of the numerical indicia is approximately the same as the indicia.

* * * * *